US005795175A

United States Patent [19]

Barr

[11] Patent Number: 5,795,175

[45] Date of Patent: Aug. 18, 1998

[54] RECTANGULAR HAND-MOUNT CONNECTOR

[75] Inventor: John E. Barr, Brea, Calif.

[73] Assignee: Aero Electric Connector System, Inc., Cerritos, Calif.

[21] Appl. No.: 392,641

[22] Filed: Feb. 21, 1995

[51] Int. Cl.[6] ..... H01R 13/327

[52] U.S. Cl. ..... 439/358; 439/681

[58] Field of Search ..... 439/681, 680, 439/358, 359, 587, 589

[56] References Cited

U.S. PATENT DOCUMENTS

| | | | |
|---|---|---|---|
| 3,491,330 | 1/1970 | Barnhart et al. | 439/681 |
| 3,753,212 | 8/1973 | Yamada et al. | 439/358 |
| 4,979,914 | 12/1990 | Robbins et al. | 439/681 |
| 5,066,242 | 11/1991 | Martucci | 439/587 |
| 5,310,358 | 5/1994 | Johnson et al. | 439/358 |
| 5,397,242 | 3/1995 | Laisne et al. | 439/681 |

*Primary Examiner*—Hien Vu

*Attorney, Agent, or Firm*—Robbins, Berliner & Carson, LLP

[57] ABSTRACT

A rectangular hand-mounted connector with d-shaped geometrical bay areas for providing easy mounting or dismounting compatibility in a commercial application without the use of any special tool is disclosed. The connector system uses a plurality of hooks located at the top and bottom of the receptacle shell to mate with a plurality of draw latches or bail latches at the top and bottom of the plug shell. In an alternative embodiment, a vertical clamping latch system is used to engage the receptacle and plug assembly. A polarization key in the receptacle shell provides latch tension when it is mated with its mating part from the plug shell. Strain reliefs may be connected to the receptacle or plug shell and may further having a plurality of ground studs for grounding the electrical contacts.

14 Claims, 13 Drawing Sheets

RECTANGULAR HAND-MOUNT CONNECTOR

BACKGROUND OF THE INVENTION

1.1 Technical Field

The present invention relates to connectors useful in commercial applications.

As used herein, the term "connector(s)" means electrical connectors commonly used in commercial application, for example, in the environment of aircraft operation. Specifically, the connectors include those quick connect/disconnect, rectangular electrical connectors such as the ADG general purpose connector-designated as AE99.

1.2 Description of Background Art

Electrical connectors and their coupling assemblies find wide use in commercial applications. The connectors are generally sealed to withstand extreme environmental conditions such as extreme temperature, moisture and a variety of other fluids used in aircraft or other applications. The connectors are needed to withstand such conditions as moisture condensation, corona, flashover and vibrations, providing an environmentally resistant assembly when the connector's plug and receptacle assembly halves are mated. In the past, a center jack screw is one of the methods used to connect the receptacle and plug assembly of the connectors. The use of such a center screw, however, provides only marginal interfacial seal under certain conditions. Also, a special tool for mating and unmating the jack screw is required making it cumbersome to operate. No positive identification of complete mating is inherently visible by the use of the center jack screw. It also can be very difficult to access the jack screw because of interference by the wire bundles.

There is a continuous and urgent need for a rectangular connector assembly with high contact density that can be used in commercial and aerospace applications that can be mated and unmated without the use of any special tool.

Moreover, a need also exists for a connector that provides positive indication when connector is fully mated.

There is also a need to provide easy access to a coupling mechanism even when inserts are filled with wires.

There is also a need to provide a multiple mounting configurations to maximize the use of space.

There is a need to provide a front releasable, rear installable insert for easy servicing in the rectangular connector assembly.

There is a need to provide inserts with key to special bays of connector to prevent incorrect assembly.

There is a need to provide for proper compression and sealing regardless of contact distribution.

SUMMARY OF THE INVENTION

Accordingly, it is an object of the art to provide a compound spring system on latches to assure correct position of components for proper mating. A spring loaded polarization key is used to provide consistent latch pressure for operation and locking.

A further object of the art is to provide for a "snap-in" receptacle. When the plug is installed, the receptacle cannot be removed from panel due to tabs on mounting latches bearing on mated plug.

It is an object of the art to provide removable inserts with integral latch member. They do not require additional "clips" or other hardware to provide retention in the shells.

In accordance with these and other objects, a rectangular hand-mounted connector in accordance with a preferred embodiment of the present invention having:

(A) A receptacle assembly has: a receptacle shell having a plurality of bay areas; the bay areas are provided for EMI springs and further protruding with closed entry socket openings connected to socket contacts and to triple seal grommet design; the bay areas are further provided with insert key-ways and is of a d-shaped geometry; the shell further having at its center a polarization key providing latch tension through a spring; and a plurality of hooks located at the top and bottom of the receptacle shell; and (B) A plug assembly has: a plug shell having a plurality of mating bay areas; the bay areas are protruding with pins connected to pin contacts and to triple seal grommet design; the mating bay areas are further provided with mating insert keys and is of a d-shaped geometry; the plug shell further having at its center a polarization key mating parts providing latch tension when mated with the polarization key form the receptacle assembly; a plurality of draw or bail latches located at the top and bottom of the plug shell providing engagement with the hooks of the receptacle shell.

In another aspect of the invention, the rectangular connector assembly includes a plurality of draw latches on the plug assembly further having a plurality of links, the links comprise extensions with a plurality of first holes from the plug shell; first positively pressured springs for mounting first rods to latch links through the plurality of first holes; and sides of the latch links with a plurality of second holes; second positively pressured spring for mounting second rods to latch links through the plurality of second holes.

In another aspect of the invention, the rectangular connector assembly further includes a bay area of the receptacle shell having insert retaining clips to remove the closed entry socket openings connected to socket contacts and to triple seal grommet design from the receptacle shell.

In another aspect of the invention, the rectangular connector assembly further includes a bay areas of the plug shell having insert retaining clips to remove the pins connected to pin contacts and to triple seal grommet design from said plug shell.

In another aspect of the invention, the rectangular connector assembly further includes a receptacle or plug shell having a strain relief attached to the receptacle or plug shell by screws.

In another aspect of the invention, the rectangular connector assembly wherein the strain relief further has a plurality of ground studs for grounding electrical contacts.

In another aspect of the invention, the rectangular connector assembly having a receptacle shell mounted to a panel by heli-coils for p/c mounting.

In another aspect of the invention, a rectangular hand-mounted having:

(A) A receptacle assembly comprises: a receptacle shell having a plurality of bay areas; the bay areas are provided for EMI springs and further protruding with closed entry socket openings connected to socket contacts and to triple seal grommet design; the bay areas are further provided with insert key-ways and is of a d-shaped geometry; the shell further having at its center a polarization key providing latch tension through a spring; and a plurality of vertical clamping latches located at the top and bottom of the receptacle shell providing engagement with the latch pins of the plug shell; and (B) A plug assembly comprises: a plug shell having a plurality of mating bay areas; the bay areas are protruding with pins connected to pin contacts and to triple seal grommet design; the mating bay areas are further provided with mating insert keys and is of a d-shaped geometry; the shell further having at its center a polarization key mating parts providing latch tension when mated with the polarization key form the receptacle assembly; a plurality of latch pins located at the top and bottom of the plug shell.

BRIEF DESCRIPTION OF THE DRAWING

The above and other features of the present invention may be fully understood from a consideration of the following description of the preferred embodiments taking in conjunction with the accompanied drawings, wherein similar characters refer to similar elements throughout and in which.

DETAILED DESCRIPTION OF THE PREFERRED EMBODIMENT

Figure 1C:
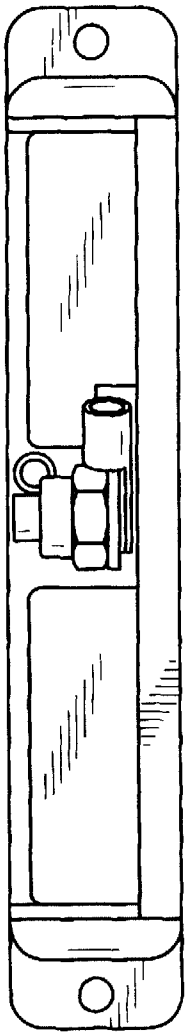
FIG. 1B is a partial cross-sectional view and FIG. 1C is a right rear view of a receptacle assembly with a strain relief for screw mounting of the present invention.
Figure 1B:
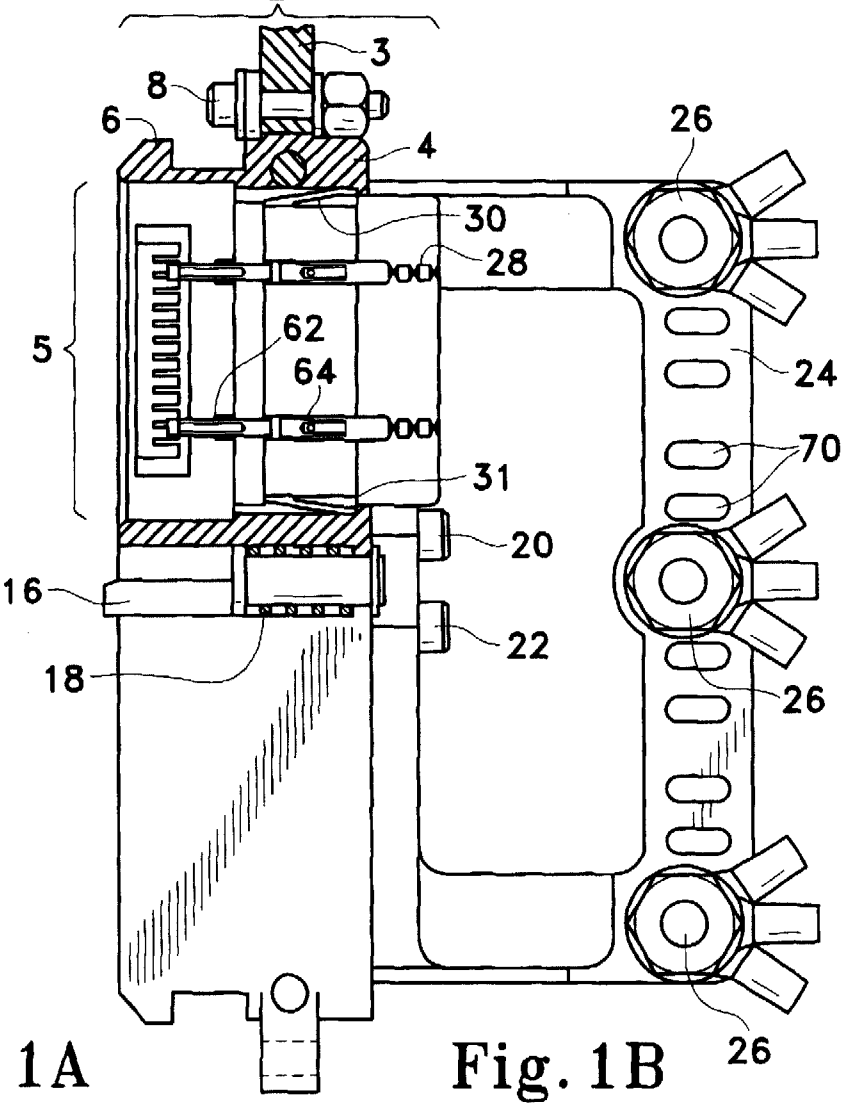
Figure 1A:
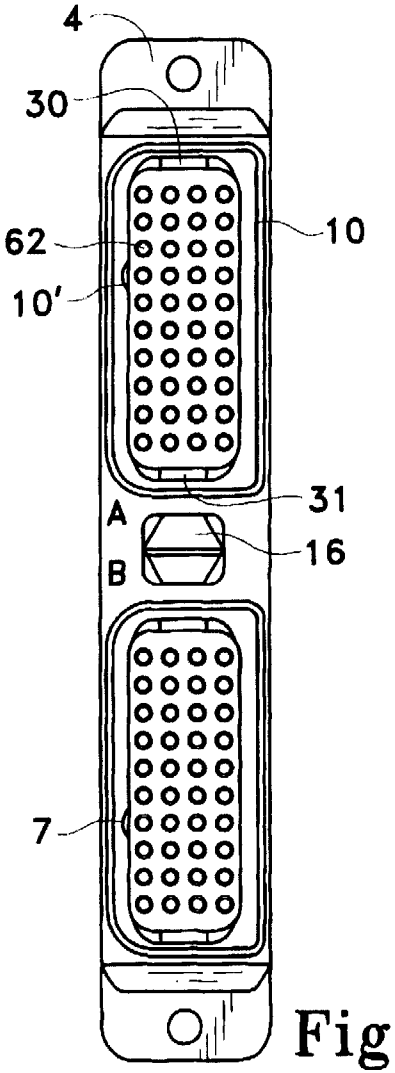
FIG. 1A is a left, frontal view.

FIG. 1 is a schematic representation of the rectangular hand-mounted connector's receptacle assembly 2 for screw mounting. FIG. 1B is a cross-sectional view of the receptacle showing that the shell 4 of the receptacle 2 is mounted to a panel 3 by a screw 8. As shown in FIG. 1A, the shell 4 comprises two bay areas A and B. Each of the bay areas A and B contains 20 electrical closed entry socket opening 62, or, in the alternate, pins. The bay area A is shown with insert retaining feature-tab-fingers 30 and 31 that retain and can allow removal of the insert assembly 5 from the receptacle 2. The same design applies to bay area B. At the right and left frontal edges of the bay areas, they are space provide for EMI springs 10 and 10'. The bay areas A and B are provided with insert key-way 7 and is of a d-shaped geometry so that correct mating with the plug 48 are assured. At the center of the shell (see FIG. 1A), there is a 6-position polarization key 16. A spring 18 is used to provide for latch tension through the polarization key 16. For the insert assembly 5 of the receptacle 2, it has a triple seal grommet design 28, attached to a socket contact 64 then to a close entry socket opening 62. Optionally, a strain relief 24 is attached to the receptacle 2 by screws 20 and 22. The strain relief 24 has a plurality of holes 70 for TY-wrap cable ties and ground studs 26 to provide grounding capability to the connector shell/panel. The number of ground studs may vary and in FIG. 1B, three ground studs are shown as an example. On the top and bottom of the shell 4 of the receptacle, hooks 6 and 6' are used to engage the draw latches 76 and 76' from the plug 48.

Figure 2B:
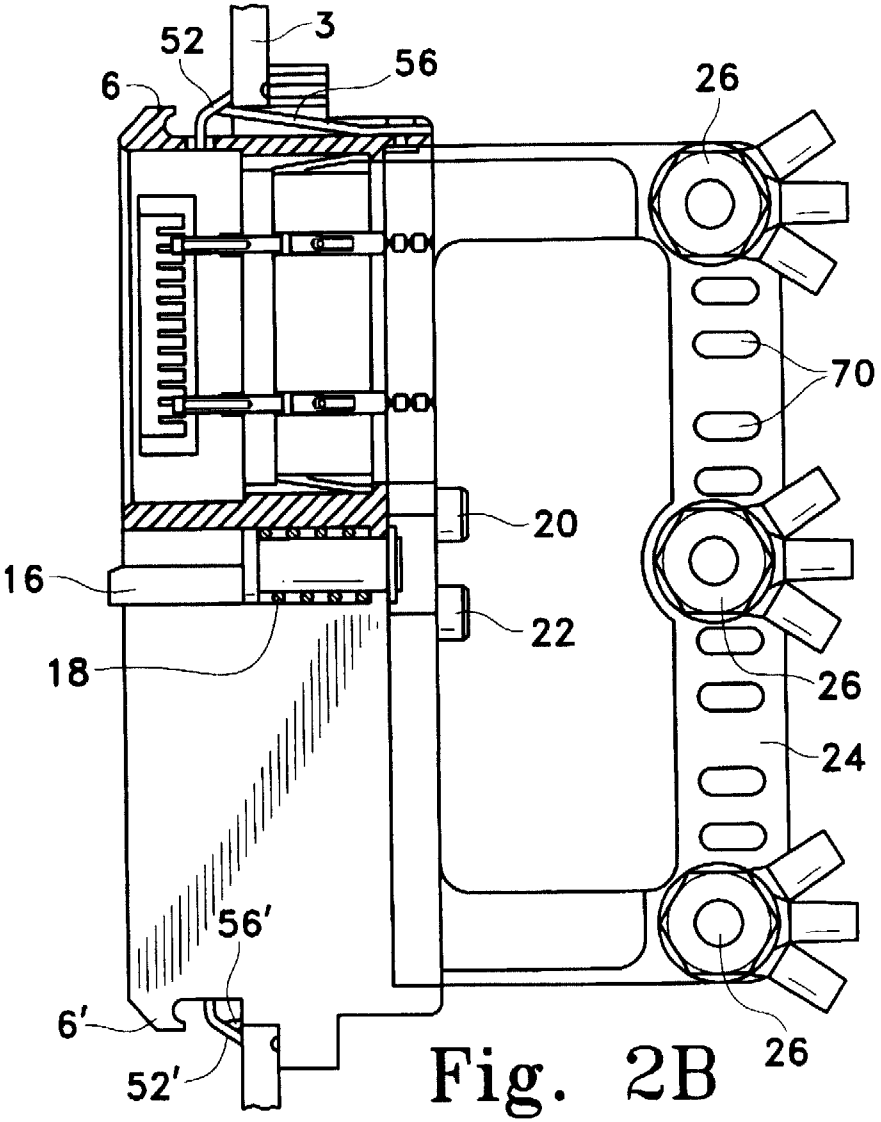
FIG. 2B is a partial cross-sectional view of the receptacle for "snap in" assembly with a strain relief for a spring latch system of the present invention.
Figure 2A:
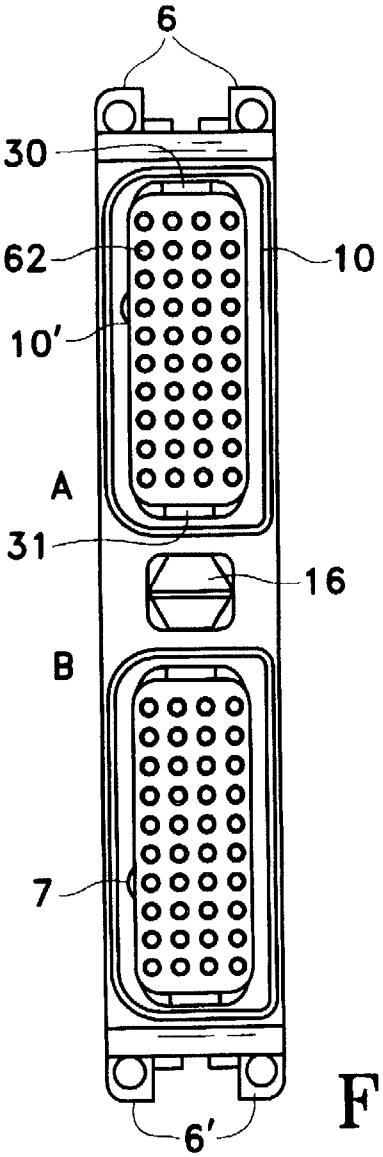
FIG. 2A is a left, frontal view

In another embodiment, spring latches 52 and 52' are used to secure the shell 4 of the receptacle 2 to a panel 3 instead of the screw 8. (See FIG. 2A and 2B) . The spring latches have panel thickness compensation devices 56, 56' to assure good electrical contact with the panel 3 for mounting. Also shown in FIG. 2A, the hooks 6 and 6' of the receptacle 2 are separated (i.e. the center piece is missing) for mating with the draw latches 76 and 76' of the plug 48.

Figure 3B:
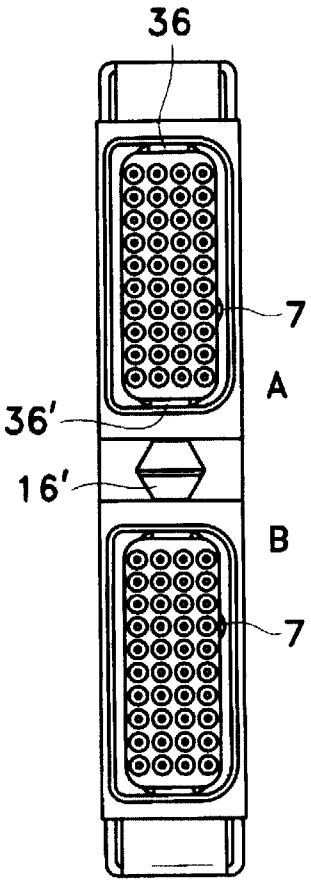
FIG. 3B is a right, frontal view
Figure 3A:
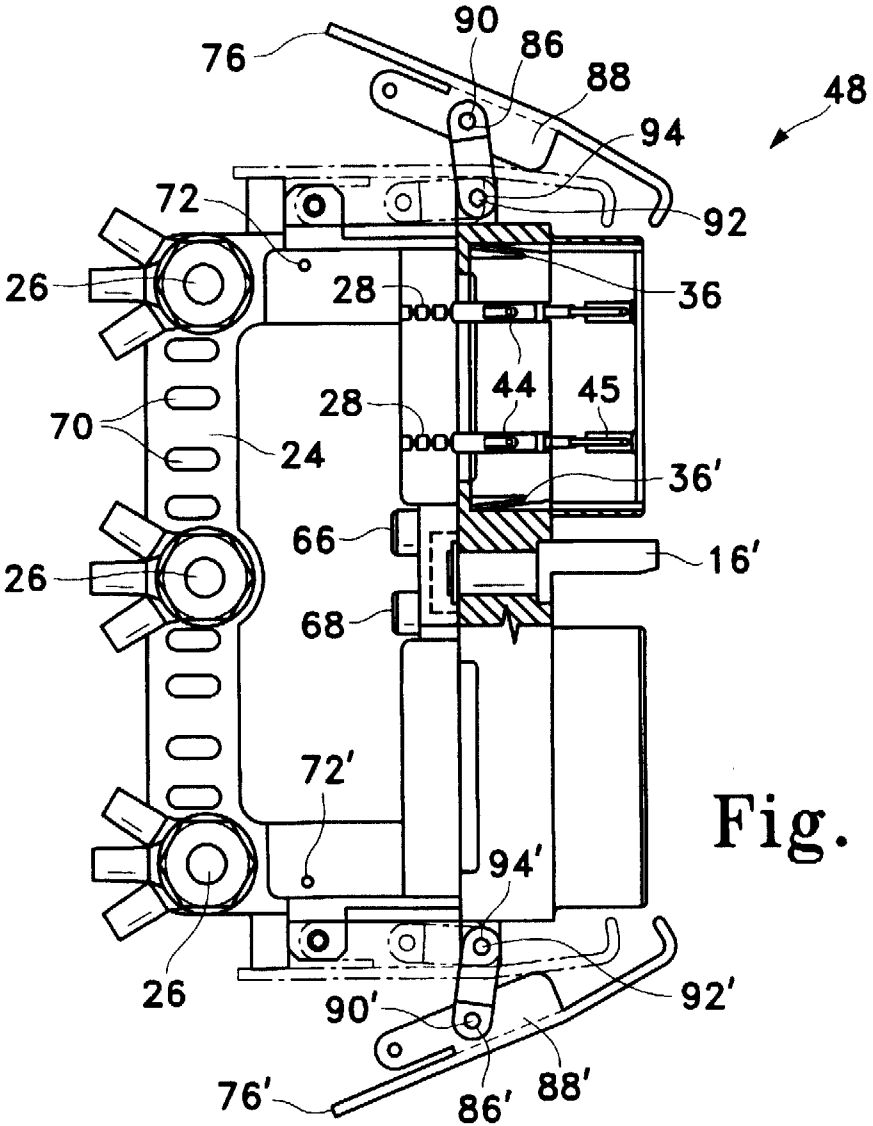
FIG. 3A is a partial cross-sectional view of the plug assembly having a draw-latch system with a strain relief of the present invention.

In FIGS. 3A and 3B, the plug assembly 48 for the present invention is being shown. FIG. 3B is a right frontal view of the plug 48 of the connector. FIG. 3A shows that it has two latches 76 and 76'. Each latch 76 and 76', as shown in FIG. 3A, is shown in an open and closed position. This can be seen more clearly in the sequence of the operation in FIGS. 6A–D. Each of the latches 76 and 76' are mounted by two positively pressured springs 82, 84 and 82' and 84' (not shown) onto the plug 48. The latches 76 and 76' have holes 86 and 86' on its sides. The latches 76 and 76' are connected to links 88 and 88' through connecting rods 90 and 90' and the springs 82 and 82' (not shown). A second spring 84 and 84' (not shown) connects the links at the bottom through rods 92 and 92' in holes 94 and 94' on extensions 96 and 96' on the plug 48. Similar to the receptacle 2, two bays, A and B, for insert key with keyway 7 and d-shaped geometry for correct matching are provided. The access points 36 and 36' for bay A were provided so that the insert assembly may be released conveniently by a U-shaped tool. The same design applies to bay area B. In the center of the plug 48 (see FIG. 3A), a 6 position polarization key mating part 16' is provide for mating with the polarization key 16 of the receptacle 2. The insert 5' (not shown) of the plug 48 is similarly comprising a triple seal grommet design 28, connected to a pin contact 44 and to a pin 45. Two captive screws 66 and 68 are used to retain the optional strain relief 24. Similar to the receptacle design, the strain relief comprises a plurality of holes 70 for TY-wrap cable ties. More importantly, at the top and bottom of the body for the strain relief safety wire holes 72 and 72' for the latches 76 and 76' are provided for secured engagement with the receptacle 2. Also, depressions 75 and 75' in strain relief extension provide locking action with latch detents 74 and 74' on the receptacle. For grounding, ground studs 26 were provided for grounding of the electrical wires. Again, the number of ground studs may vary, in FIG. 3B, three ground studs were shown.

Figure 4:
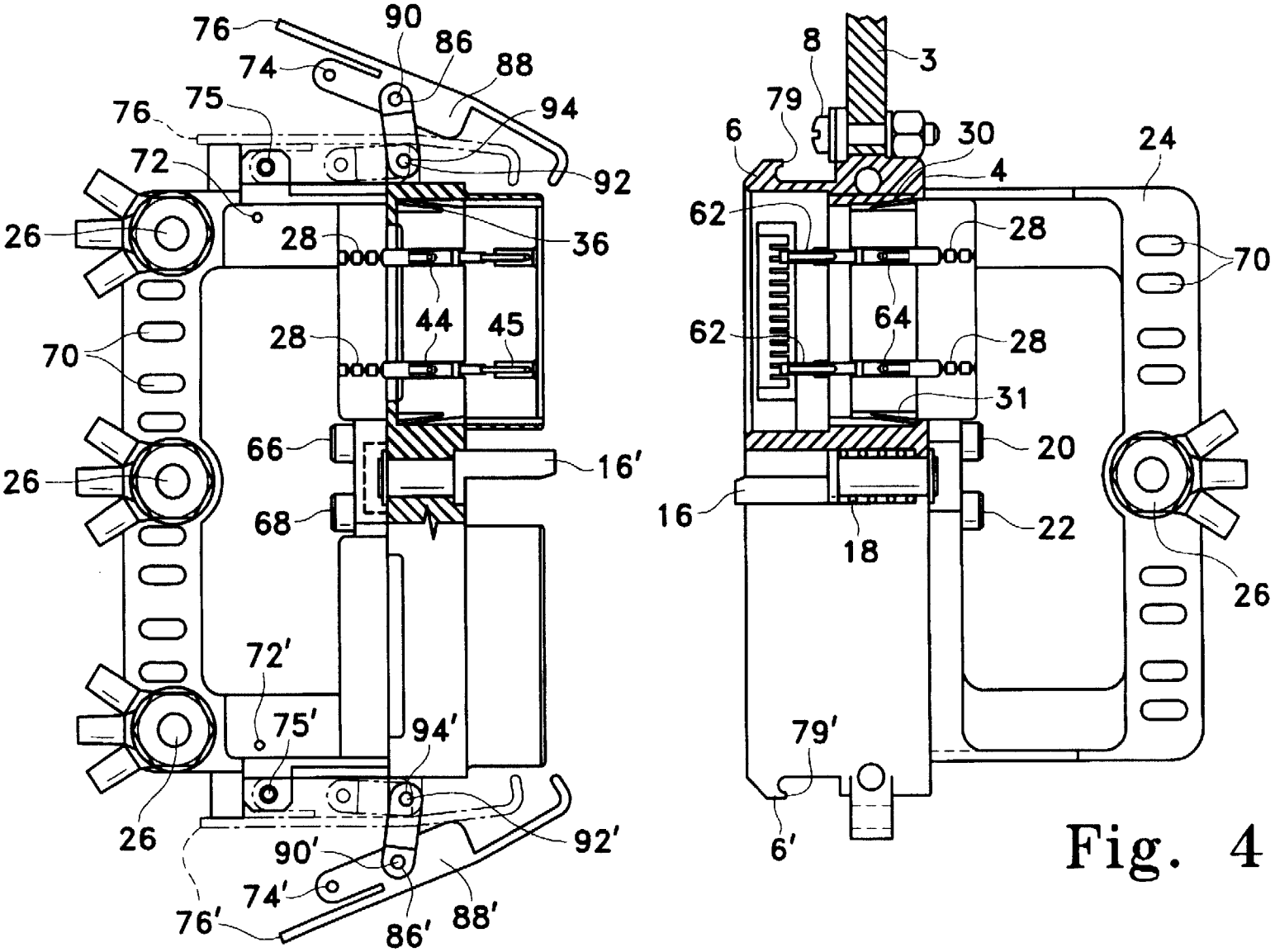
FIG. 4 is a partial cross-sectional view of the rectangular screw-mount connector receptacle and plug with strain reliefs of the present invention.
Figure 6B:
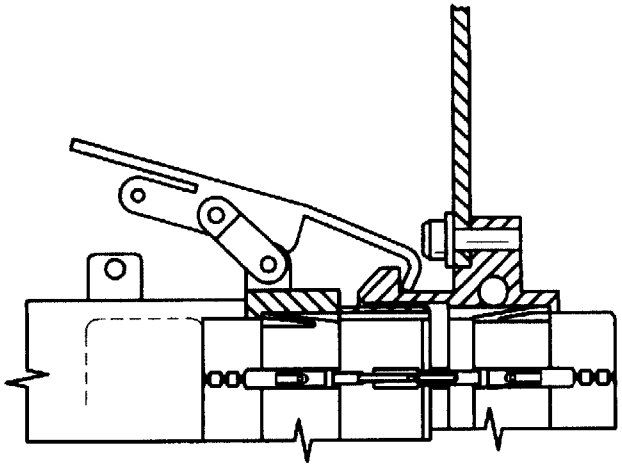
FIG. 6A–D shows the four stages of the engaging sequence of one of the two draw latches for the rectangular hand-mount connector for screw mounting of the present invention.
Figure 6D:
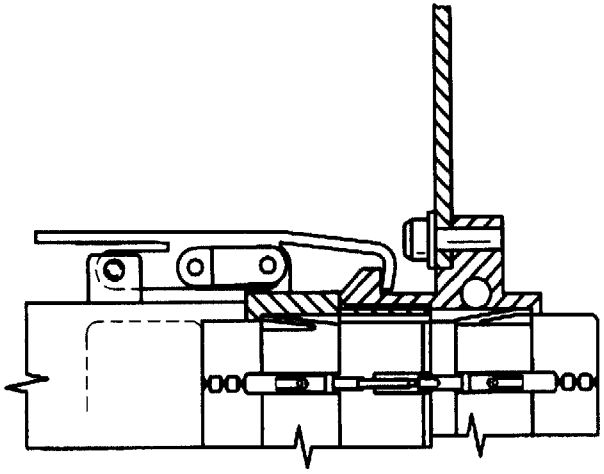
Figure 6A:
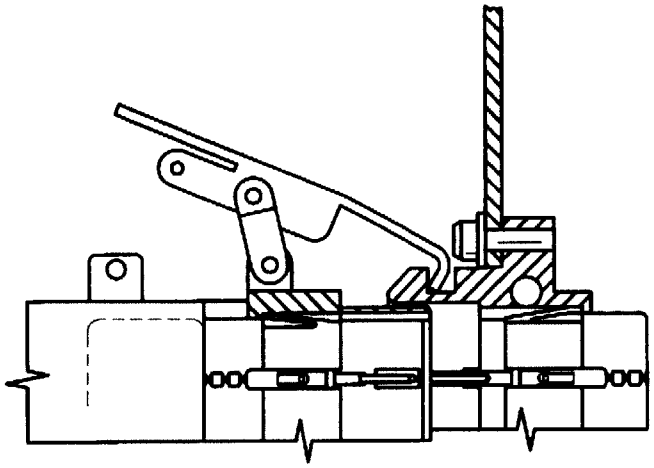
Figure 6C:
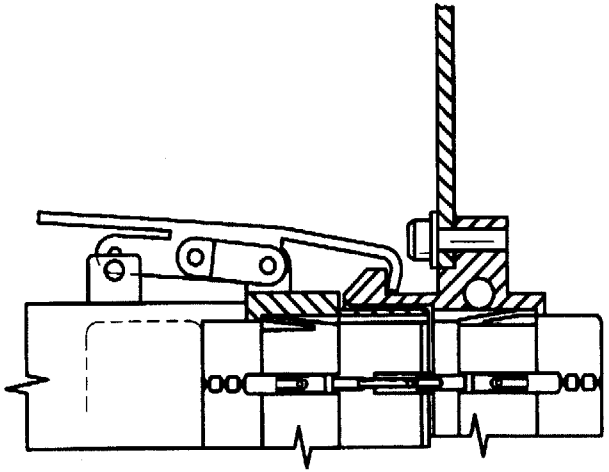

The latches 76 and 76', as shown in FIG. 4, can be moved from a fully-open to a fully-closed position. This can be seen in the sequence of the operation in FIGS. 6A–D. In FIG. 6A, at stage 1, the latch 76 is at a fully-open position with the lip 79 of the latch 76 being placed in the hook 6. At this stage, the connector shells 4 and polarization keys 16 and 16' were engaged, socket contacts 64 have just entered opening 62 of shell 4 but have not engaged the pin contact 44. At stage 2, the pin 45 and socket contacts 64 have engaged, the latch 76 has moved at approximately 7° and the EMI/RFI spring 10 has made contact between the plug 48 and the receptacle shells 4. At stage 3, the pin 45 and socket contact 64 was made, and the latch has now moved approximately 20° and is at its center point. At stage 4, the connector is in its final matable condition, the interfacial seal 32 is at maximum compression. The spring authorization key 18 has been compressed and is providing tension to lock latch 76. Though, only the mating sequence of latch 76 and the hook 6 is described, the lower latch 76' is also mated with its hook 6' in the same manner. Because of the spring 18 tension, under all situations, the mating of the latches 76 and 76' with the hooks 6 and 6' occur at the same time to provide proper mating. In general, the latches 76 and 76' have moved approximately 3° over center to the final positions. At the end, latch detents 74 and 74' on the receptacle engages depressions 75 and 75' in strain relief extension to provide locking action. Safety wire holes 72 and 72' may be provided for secure engagement of the latches after mating.

Figure 5:
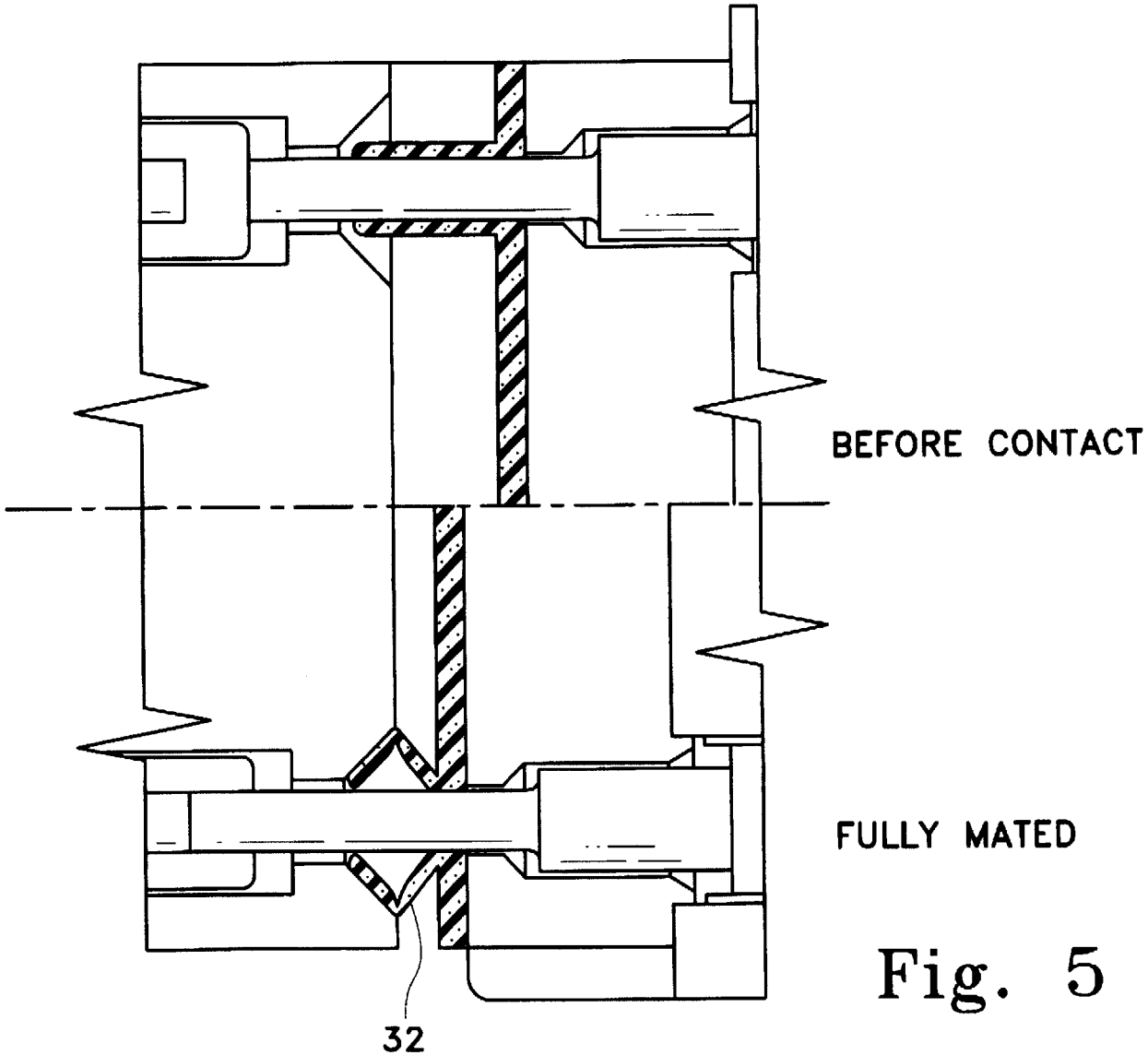
FIG. 5 is a cross-sectional view of a controlled collapse interfacial seal before contact and after mating of the present invention.

As can be seen in FIG. 5, the interfacial seal 32 was controlled and collapsed during the mating process to provide a better contact engagement.

Figure 8C:
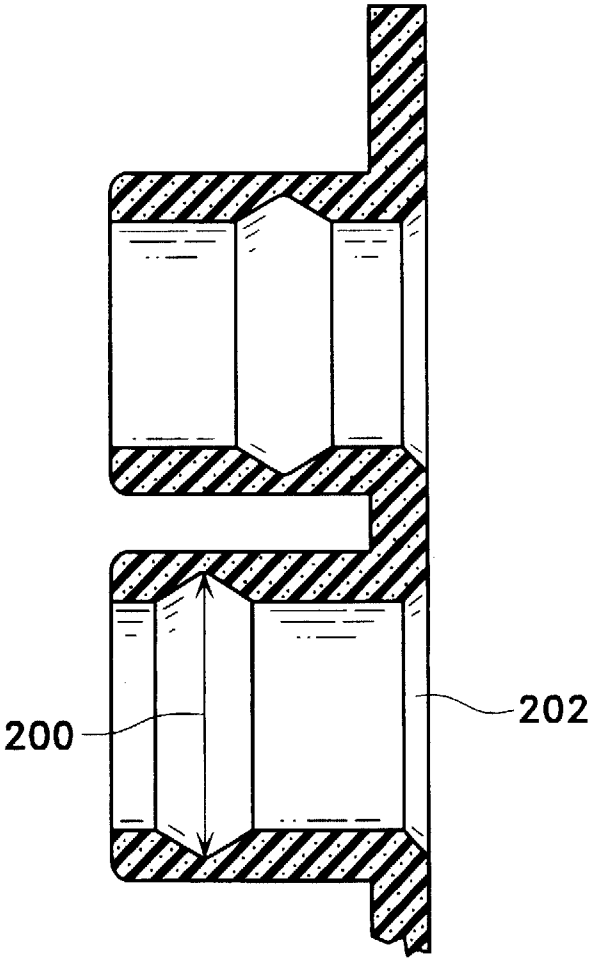
FIG. 8B is a cross-sectional view and FIG. 8C is a seal detail of the interfacial seal-pin insert layout.
Figure 8B:
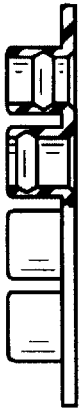
Figure 8A:
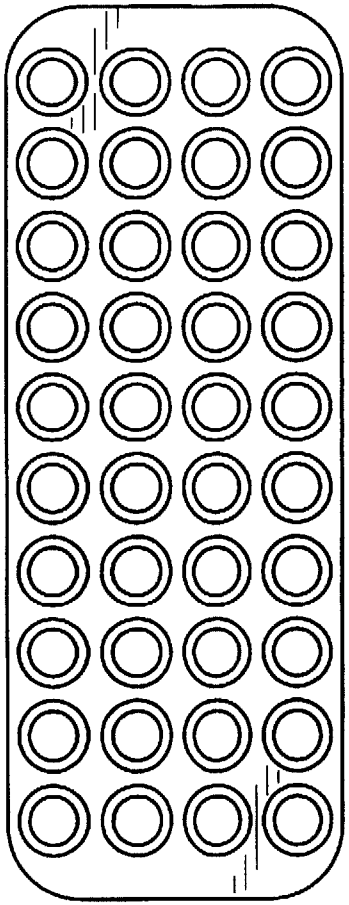
FIG. 8A is a frontal view.

In order to provide for adequate grounding and to avoid electrical interference, the seals 200 for the pins can be adjusted so that when mated, they are at different height from the base line 202. This way, the grounding to the ground stop can be accomplished at different column heights (see FIG. 8). This further reduces any possible electrical interferences because of crowding of the contacts.

Figure 7:
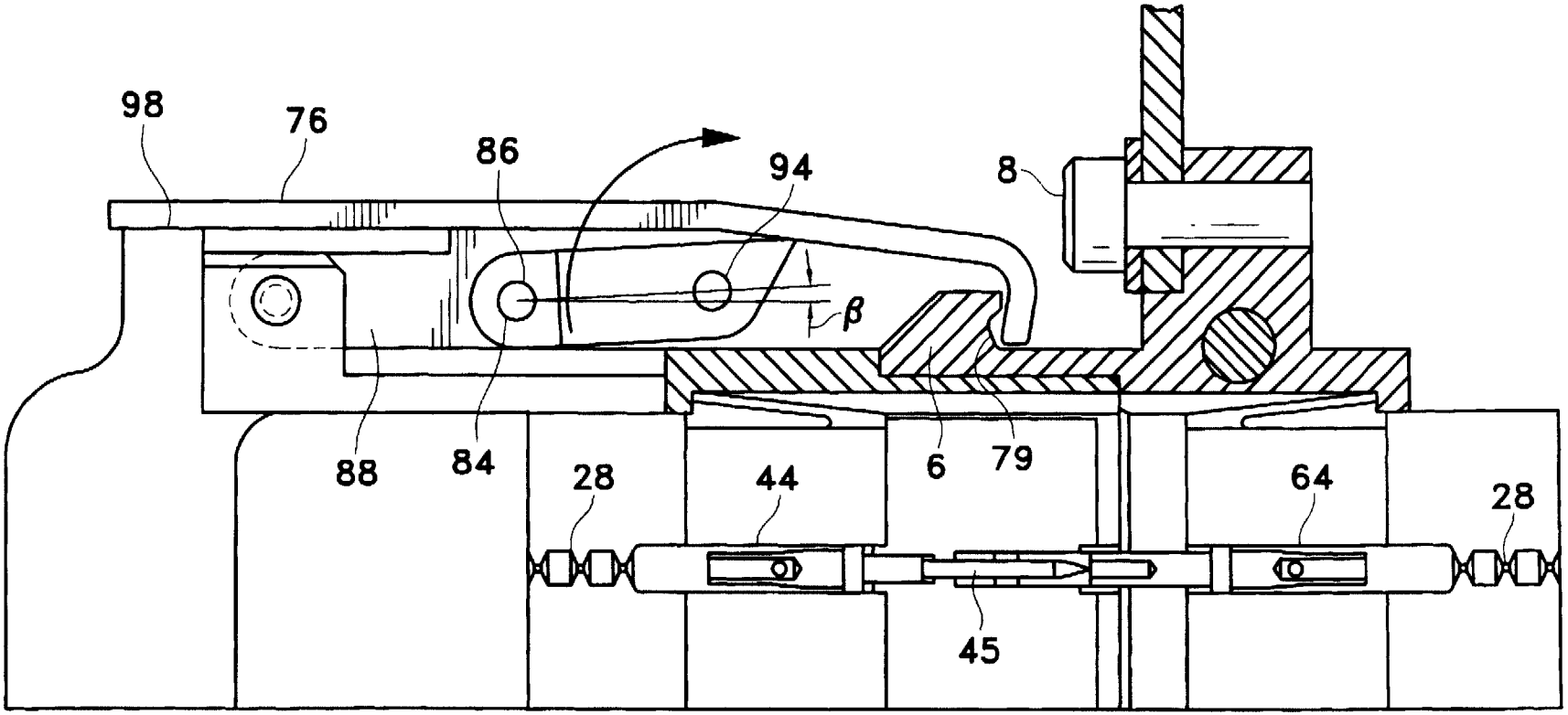
FIG. 7 shows a limit stop surface on a backshell of the plug for secure engagement of the rectangular handmount connector of the present invention.

As can be seen in FIG. 7, a limit stop surface 98 on the backshell of the plug 48 is necessary to prevent the link spring 84 from rotating the latch 76 regardless of plug 48/receptacle 2 position or clearances of the components. This is particularly true when the plug and receptacle are pushed further together after mating. The link 88 is being held at an angle β by a line joining the two holes 86 and 94 with the horizontal surface (see FIG. 7). In this case β is found preferably from 4° to 10° to provide safety for engagement. The same design also applies to the lower latch link 88' forming an angle β by a line joining the two holes 86' and 94' with the horizontal surface. By having the limit stop surface, the latches 76 and 76' no longer depend on the lip 79 of the hook 6 for position.

While particular embodiments of the invention has been shown and described, it will be obvious to those skilled in the art that changes and modifications may be made without departing from the invention in its broader aspects. For example, as described earlier the receptacle may be of a conventional design and used to positively retain the inserts. The rectangular receptacles can be a screw-mounted design or have snap-in feature, such as spring latch, which does not require the use of screws, nuts and washes, mounting hardware or tools for installation.

The shell and strain relief may be fabricated from any suitable metal, e.g. aluminum alloy. When finished, the aluminum alloy may be coated with electroless nickel or CAD/OD over electroless nickel.

The bail, lever, pins, key, spring studs and fasteners may be constructed of any suitable metal, e.g. 300 series stainless steel. When furnished, the stainless steel may be passivated.

As far as the insert is concerned, two mechanically keyed symmetrical inserts should be installed per connector shell. The inserts should be removable and mechanically retained. The inserts are designed and constructed so as to eliminate all air paths between contacts and shells when the connectors are mated. The socket insert face shall be resilient. The insert and wire sealing members of connectors shall be essentially one integral part, consisting of one or more parts bonded together so as to form essentially one integral piece and shall provide suitable sealing around the wires having diameters within the range of 0.030–0.142 inch. The insert so designed in size 16, shall be used to carry 13 amperes at 120° C. In a size 20 bussing, it will be able to carry 7.5 amperes at 125° C.

The inserts are constructed of glass filled polyester thermoplastic, such as Valox 420. The grommet and interfacial seal on the other hand may be made of fluorosilicone and silicone bend elastomer.

For the number of electrical contacts in each bay of the receptacle assembly, currently it varies from 14 to 40.

Figure 9C:
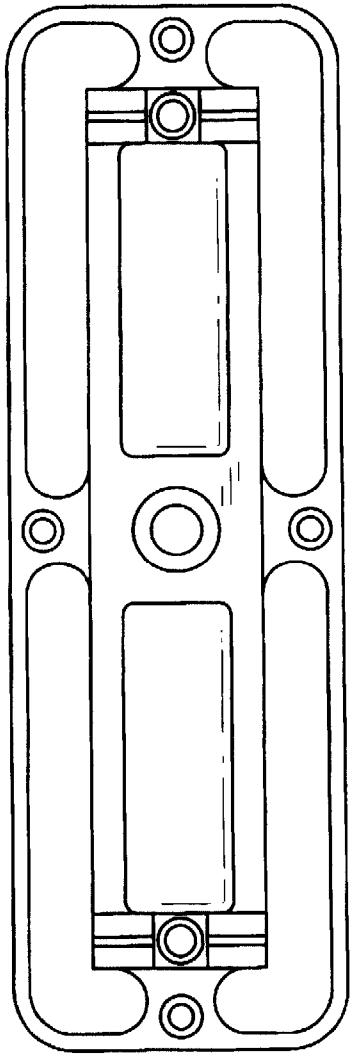
FIG. 9B is a partial cross-sectional view and FIG. 9C is a left, rear view of the receptacle assembly for PC mounting.
Figure 9B:
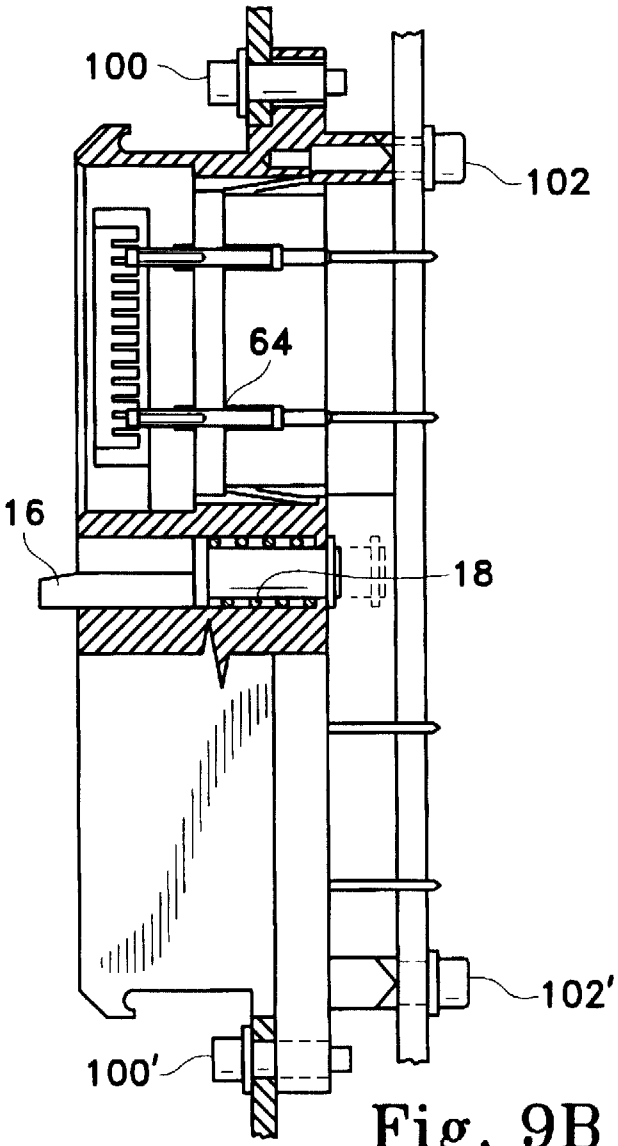
Figure 9A:
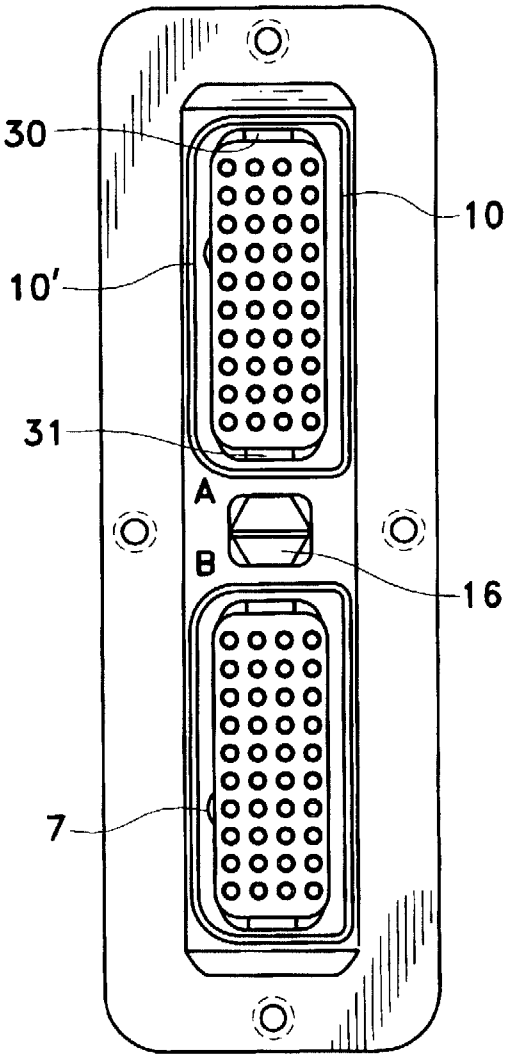
FIG. 9A is a left, frontal view.

In FIG. 9B, screws 100 and 100' are shown for mounting the rectangular connector receptacle to the panel. Two screws 102 and 102' are then used to mount the connector receptacle to the p/c. Here, the material of construction is similar to the general purpose connector assembly except when finished, the contacts are gold over nickel, over copper alloy. Also, the retaining feature-tab-finger and EMI spring are fabricated of heat treated berylium copper. In the Figures, the receptacle 2 is shown with socket contacts 64 for connection, but it is interchangeable to comprise of pin contacts 44 for connection and vice versa for the plug 48. Also, the latches can be placed on the receptacle assembly and engage with the hooks now located on the plug assembly instead.

Figure 10B:
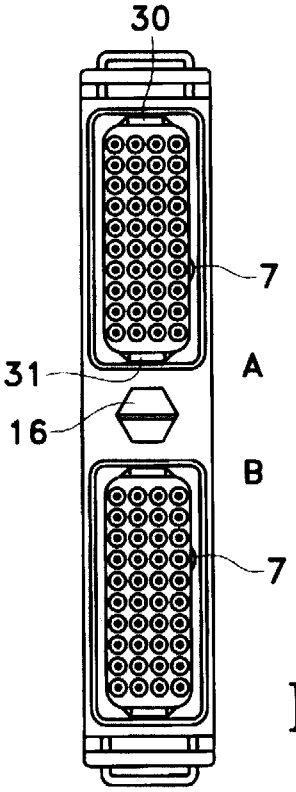
FIG. 10B is a left, frontal view
Figure 10A:
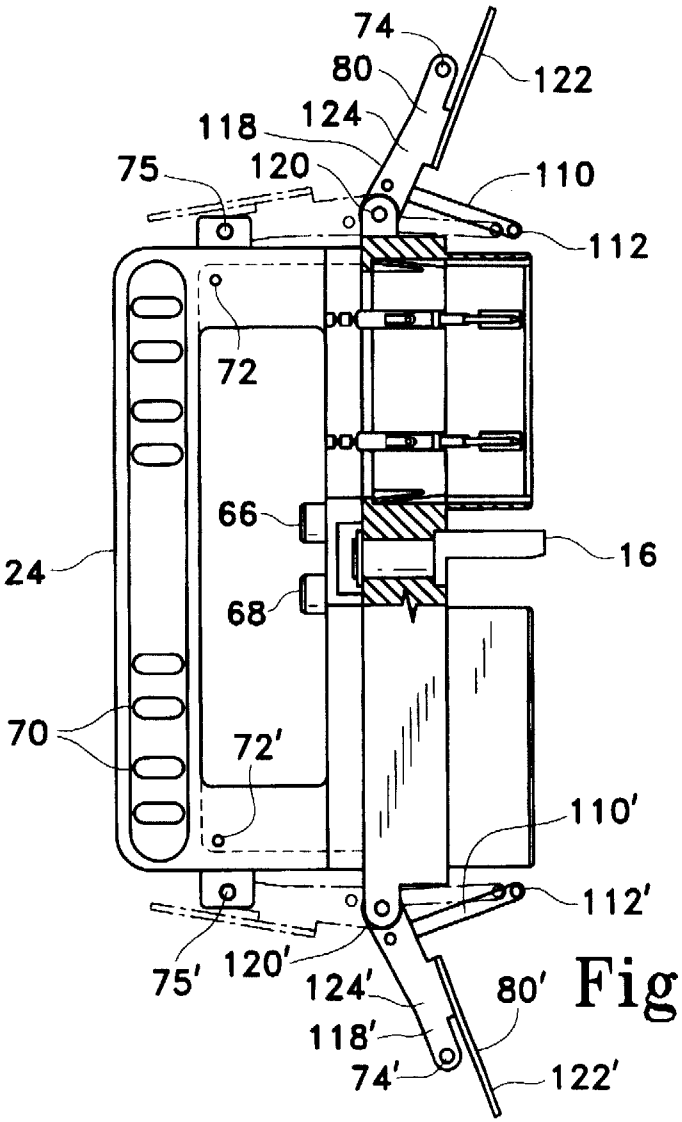
FIG. 10A is a partial cross-sectional view of a plug assembly having a bail-latch system with a strain relief of the present invention.

FIGS. 10A and B show an alternative embodiment using bail latches 80 and 80' for engaging the rectangular connectors. Here, the bail latches 80 and 80' are first in an open position. The bail latches 80 and 80', each comprises two parts. The first part engaging arms 110 and 110' are constructed of stainless steel. At its anterior end 112 and 112', metal rods 113 and 113' are used to engage the plug 48 to the hooks 6 and 6' of the receptacle 2 of the connector. At its posterior end 114 and 114', it is connected by springs 116 and 116', e.g. of the 300 series stainless steel, to the second part levering arms 118 and 118' of the bail latches 80 and 80'. The second part levering arms 118 and 118' of the bail latches 80 and 80' in turn connected to the plug 48 of the connector through second springs 120 and 120'. In FIG. 10A, the second part levering arm comprises a handle 122 and 122' for manual operation which connected to an extension 124 and 124' on the plug by spring 120 and 120'.

Figure 11B:
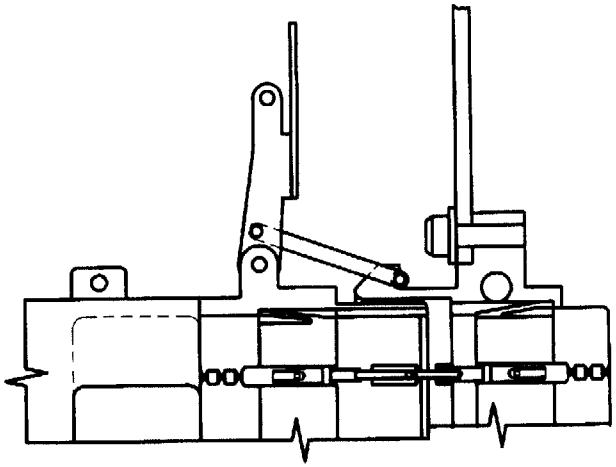
FIG. 11A–D shows the four stages of the engaging sequence of one of the two bail latches for the rectangular hand-mount connector for screw mounting of the present invention.
Figure 11D:
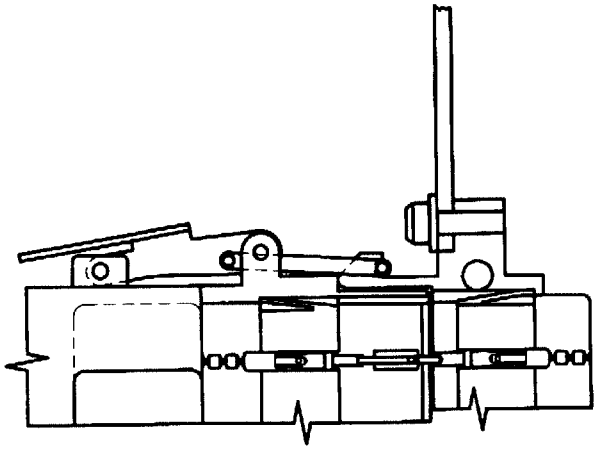
Figure 11A:
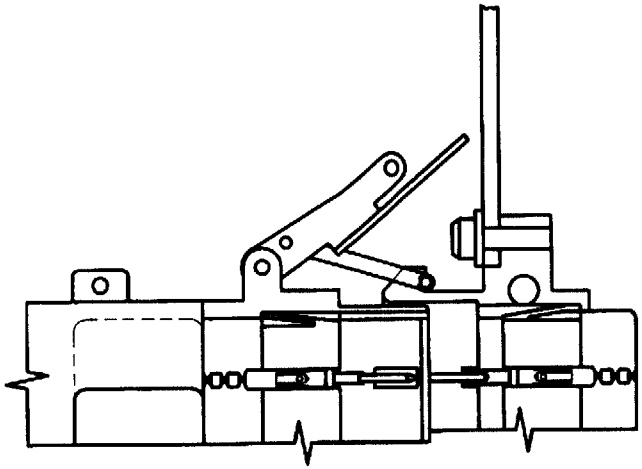
Figure 11C:
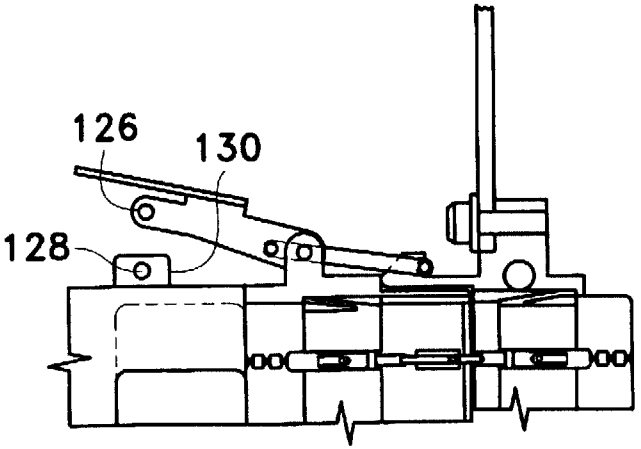

The operation sequence of the bail latches are shown in FIG. 11A–D. In FIG. 11A, the connector shells 4 and polarization keys 16 and its mating part 16' engaged, pin contact 44 has just entered opening of socket insert 64 but have not engaged socket contact 64. The bail latch 80 (and 80') is at its maximum opening. In FIG. 11B, the pin 45 and socket contacts 64 have engaged, the EMI/RFI spring 10 has made contact between plug 48 and receptacle shells 4 and the bail latch 80 (and 80') has moved approximately 50°. In FIG. 11C, maximum engagement of connector shells 4 and contacts 64 has taken place, interfacial seal 32 has been compressed to a minimum height and the batch latch 80 (and 80') has moved approximately 132° and is at its center point. In FIG. 11D, the connector assembly is in its final mated condition. The spring 18 on the polarization key 16 has been compressed and is providing tension to lock latch, and the latch 80 (and 80') has moved approximately 21° over center to its final position. The "dimples" 126 on the latch 80 and 80') engage the depressions 128 (and 128') in the strain relief boss 130 (and 130') to provide a locking action. Also, safety holes 72 and 72' on the strain relief for locking the latches 80 and 80' by wires may be provided.

Figure 12B:
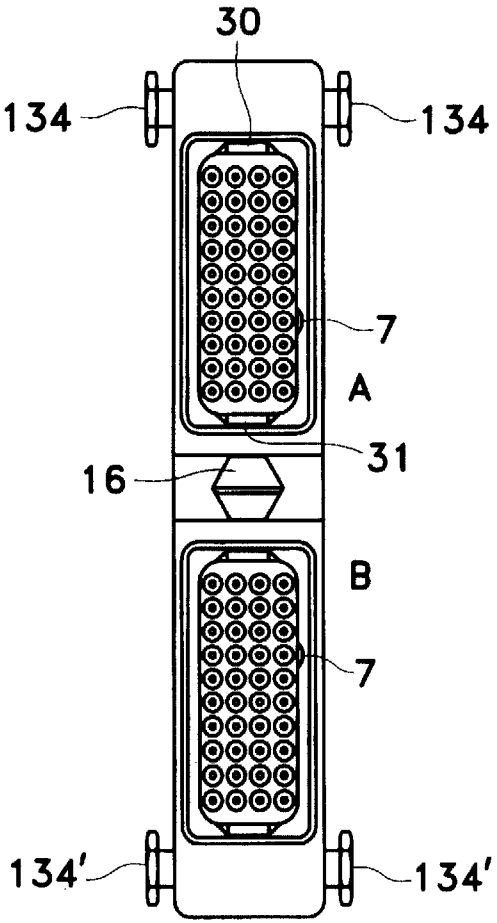
FIG. 12B is a left, frontal view
Figure 12A:
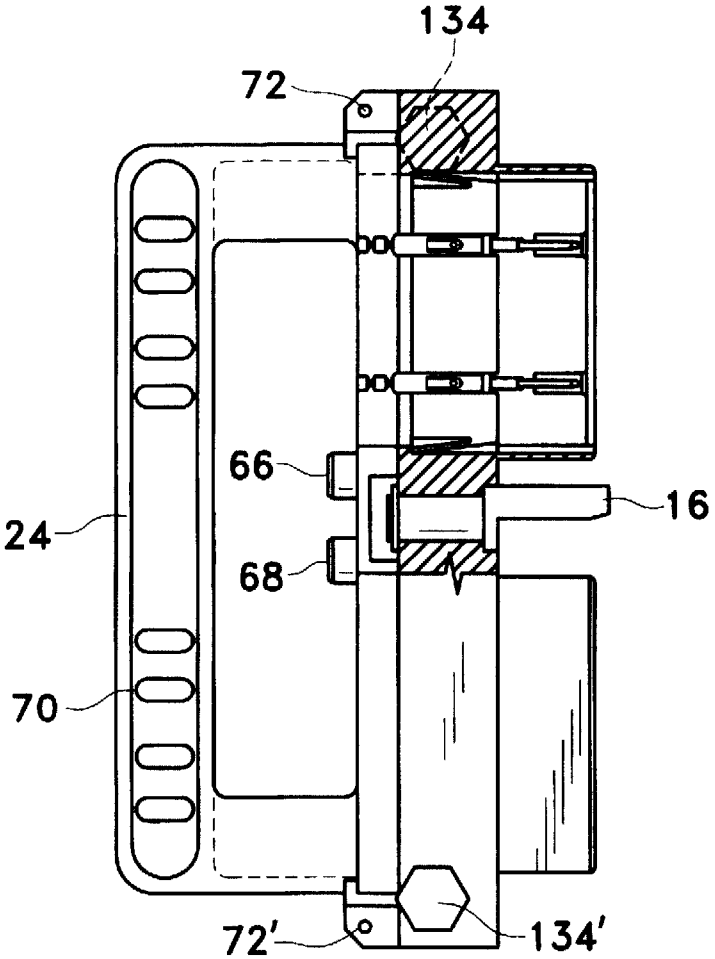
FIG. 12A is a partial cross-sectional view of a receptacle assembly with a vertical latch system with a strain relief of the present invention.
Figure 13B:
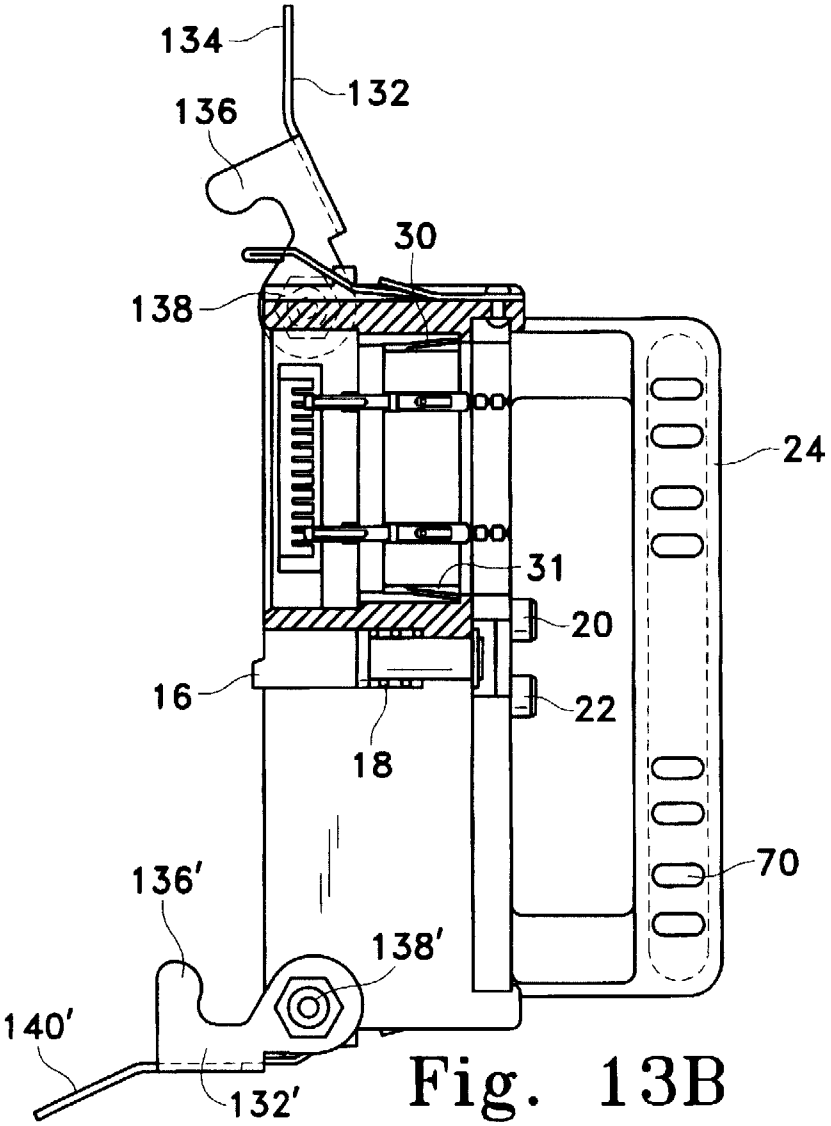
FIG. 13B is a partial cross-sectional view of a plug assembly with a vertical latch system with a strain relief of the present invention.
Figure 13A:
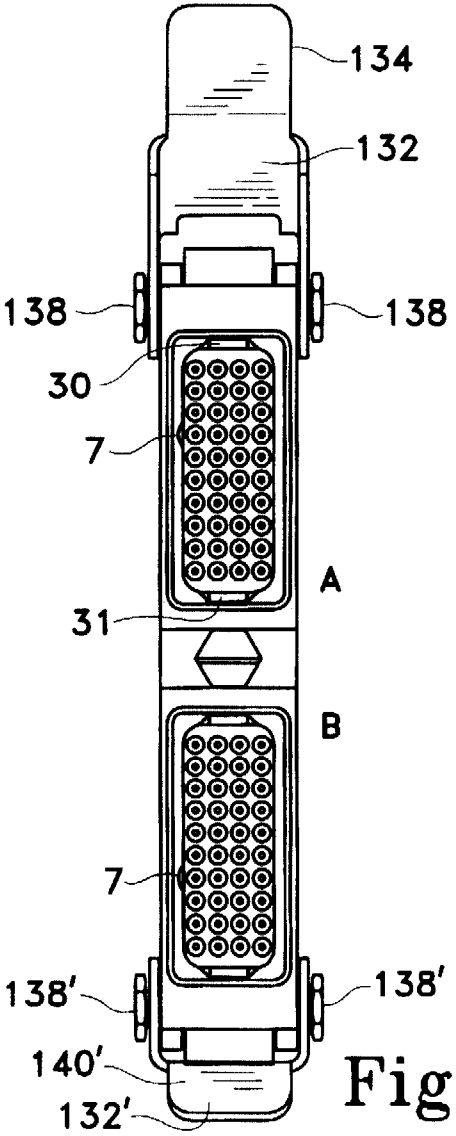
FIG. 13A is a left, frontal view

FIGS. 12A and 12B and FIGS. 13A and 13B show another alternate embodiment of the receptacle assembly with a vertical clamping latches. Here, the latches 132 and 132' are maintained at vertical open positions and are moved down to hook up with the latch pins 134 and 134' on the plug 48. The vertical clamping latches 132 and 132' comprises a handle 134 and 134', extending from a U-shaped engaging part 136 and 136'. The U-shaped engagement part 136 is connected to the receptacle 2 at rotating joint 138 and 138'. As shown in FIG. 12B, as the latches 132 and 132' are being moved down (and up) from its open position, the U-shaped engaging part 136 and 136' come down (and up) and engaging on the latch pins 134 and 134' on the plug 48. Also, near the plug 48, safety wire holes 72 and 72' may be provided to lock the latches 132 and 132' using wires.

We claim:

1. A rectangular hand-mounted connector comprising:

a. a receptacle assembly comprising:

bay areas are provided for EMI springs and further protruding with closed entry socket openings connected to socket contacts and to triple seal grommet design;

the bay areas are further provided with insert key-ways each of a d-shaped geometry;

the shell further having at its center a polarization key having latch tension through a spring; and a plurality of hooks located at a first and second end of the receptacle shell; and b. A plug assembly comprising:

a plug shell having a first and second side wall and a plurality of mating bay areas therein;

the mating bay areas are protruding with pins connected to pin contacts and to triple seal grommet design;

the mating bay areas are further provided with mating insert keys each of a d-shaped geometry;

the plug shell further having at its center a polarization key mating part having latch tension when mated with the polarization key from the receptacle assembly; and a plurality of latch assemblies each located at said first and second side walls of said plug shell for providing engagement with a hook on the receptacle shell, wherein each of said latch assemblies comprises:

a latch;

a first rod having a first and second end;

a link connected to said latch and having means connected through a first hole of said first end of said first rod; and a second rod having a third and fourth end, said third end of said second rod connected to and through a second hole of said second end of said first rod and said fourth end of said second rod connected to said plug assembly, wherein said link further comprises a detent for connecting with a depression on said plug shell.

2. The rectangular connector assembly of claim 1 further comprising:

a receptacle insert assembly; and receptacle insert retaining tabs for facilitating retention of said receptacle insert assembly.

3. The rectangular connector assembly of claim 2 further comprising:

a plug insert assembly; and plug insert retaining tabs for facilitating retention of said plug insert assembly.

4. The rectangular connector assembly of claim 3 wherein the receptacle shell is mounted to a panel by a screw.

5. The rectangular connector assembly of claim 3 wherein the receptacle shell is mounted to a panel by spring latches.

6. The rectangular connector assembly of claim 3 wherein the receptacle shell further comprises a strain relief attached to the receptacle shell by screws.

7. The rectangular connector assembly of claim 6 wherein the strain relief further comprises a plurality of holes for cable ties.

8. The rectangular connector assembly of claim 7 wherein the strain relief further comprises a plurality of ground studs for grounding electrical contacts.

9. The rectangular connector assembly of claim 8 wherein the plug shell further comprises a strain relief attached to the plug shell by screws.

10. The rectangular connector assembly of claim 9 wherein each of said depressions is located on said strain relief for engagement with each of said detents at respective end of respective latches.

11. The rectangular connector assembly of claim 10 wherein strain relief further provides holes for receiving a wire to secure said latches to said receptacle after said latches are mated with said receptacle.

12. The rectangular connector assembly of claim 11 wherein the plug shell further comprises a surface to prevent link springs from rotating latches regardless of the plug or receptacle position.

13. The rectangular connector assembly of claim 12 wherein angular rotation of the link springs of the plug shell from a central line is 4° to 10°.

14. The rectangular connector assembly of claim 13 wherein the receptacle shell is mounted to a panel by screws.

* * * * *